US007191905B2

(12) United States Patent
Robertson

(10) Patent No.: US 7,191,905 B2
(45) Date of Patent: Mar. 20, 2007

(54) COOLER DOOR SHELF DEVICE WITH STICK-ON PRODUCT PANELS

(75) Inventor: James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 115 days.

(21) Appl. No.: 10/944,246

(22) Filed: Sep. 16, 2004

(65) Prior Publication Data

US 2006/0054574 A1 Mar. 16, 2006

(51) Int. Cl.
*A47B 73/00* (2006.01)
*A47F 3/14* (2006.01)

(52) U.S. Cl. ..... 211/75; 211/88.01; 211/126; D9/600; 40/124.06

(58) Field of Classification Search ..... 211/126, 211/75, 14, 88.01, 88.03, 113; D9/600; 40/124.06, 40/308; 206/457
See application file for complete search history.

(56) References Cited

U.S. PATENT DOCUMENTS 2,069,957 A * 2/1937 Klein ..... 40/324
2,347,155 A * 4/1944 Leahey ..... 40/312
4,560,072 A * 12/1985 Burrell ..... 211/75
4,784,314 A * 11/1988 Penick ..... 229/116.3
D322,706 S * 12/1991 Grossman ..... D3/270
5,096,272 A * 3/1992 Belokin et al. ..... 312/129
5,288,046 A * 2/1994 Eklof et al. ..... 248/220.21
5,330,261 A * 7/1994 Bennett ..... 312/321.5
5,351,841 A * 10/1994 Belokin et al. ..... 211/88.01
5,358,128 A * 10/1994 Belokin et al. ..... 211/75
5,913,433 A 6/1999 Belokin et al.
2003/0080078 A1* 5/2003 Belokin et al. ..... 211/88.01

* cited by examiner

*Primary Examiner*—Richard E. Chilcot, Jr.
*Assistant Examiner*—Jared W. Newton
(74) *Attorney, Agent, or Firm*—John L. James

(57) ABSTRACT

A shelf device for an inside surface of a cooler door has a tray with a bottom panel, opposed front and rear panels connected to the bottom panel, and opposed end panels connected to the bottom, front and rear panels. The front panel has a rear face opposite the rear panel and a front face. A front display panel has an embellished front surface and has a rear surface attached to the front surface of the front panel of the tray. Openings in tray flanges receive suction cup protrusions for attaching the tray to the inside surface of the cooler door.

2 Claims, 2 Drawing Sheets

COOLER DOOR SHELF DEVICE WITH STICK-ON PRODUCT PANELS

CROSS REFERENCE TO RELATED APPLICATIONS

This application is related to co-pending application Serial No. 10/929,975 filed Aug. 20, 2004 entitled "Cooler Door Shelf Device With Removable Product Panel" and to co-filed application Ser. No. 10/944,295 entitled "Cooler Door Shelf Device With Raised Panels".

TECHNICAL FIELD OF THE INVENTION

This invention relates generally to a cooler, and, more particularly, to a door shelf device for a transparent cooler door.

BACKGROUND OF THE INVENTION

Upright coolers in supermarkets and convenience stores typically have transparent glass doors so that the products inside are visible. It is now common to use the inside of the door for shelving as is done in household refrigerators. Door shelving fits against the door so that the product containers are visible, however, the product labels do not always face forward for easy identification of the product. Some shelves have a small area for affixing product identification, but such small areas lack the impact needed, especially for impulse purchases. Accordingly, it will be appreciated that it would be highly desirable to have a door shelf device with a large area for product labeling and identification.

SUMMARY OF THE INVENTION

The present invention is directed to overcoming one or more of the problems set forth above. Briefly summarized, according to the present invention a shelf device for mounting on an inside surface of a cooler door comprises a tray and display panel. The tray has a bottom panel, opposed front and rear panels connected to the bottom panel, and opposed end panels connected to the bottom, front and rear panels. The front panel has a rear face opposite the rear panel and a front face facing the inside of the cooler door. A front display panel has an embellished front surface and has a rear surface attached to the front surface of the front panel of the tray.

The tray is attached to the inside surface of the cooler door using suction cups adhered to the inside surface of the door. The suction cups fit through openings in flanges in the tray to anchor the tray to the door. The shelf device utilizes space in the cooler that may otherwise be wasted. The display panel is used to increase visual appeal by simulating product identification at the door where it is more readily seen than that on the containers in the cooler.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
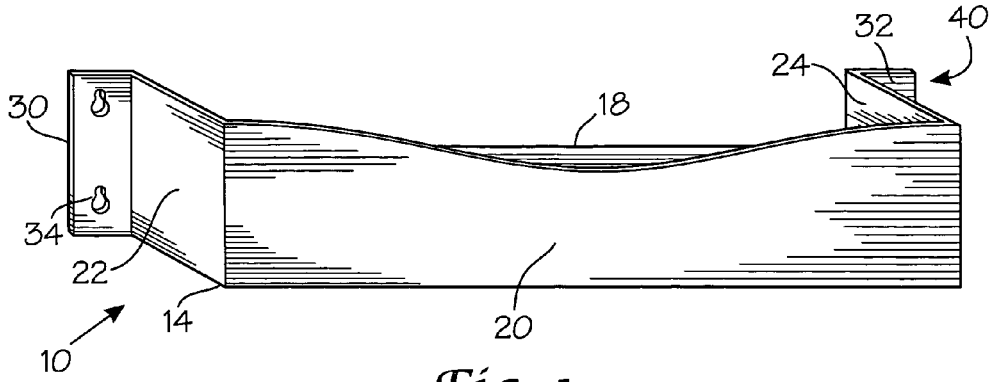
FIG. 1 is a rear perspective view of a shelf device for attaching to the inside surface of an upright cooler door according to the present invention.
Figure 2:
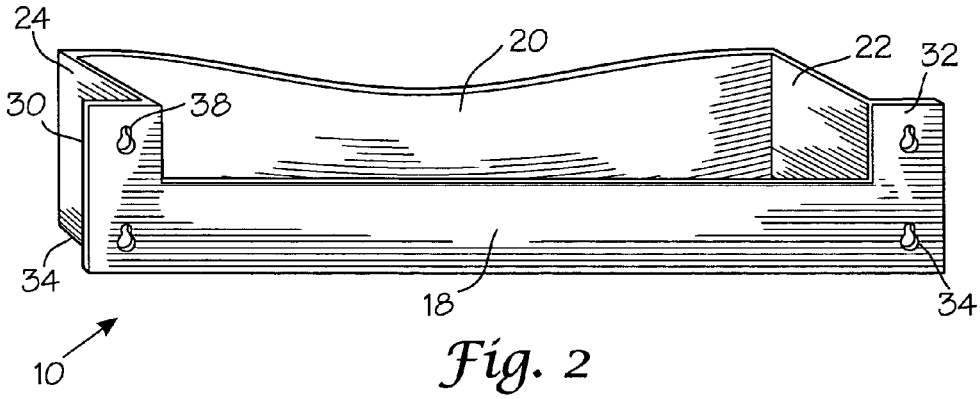
FIG. 2 is a front perspective view of the shelf device of FIG. 1.
Figure 3:
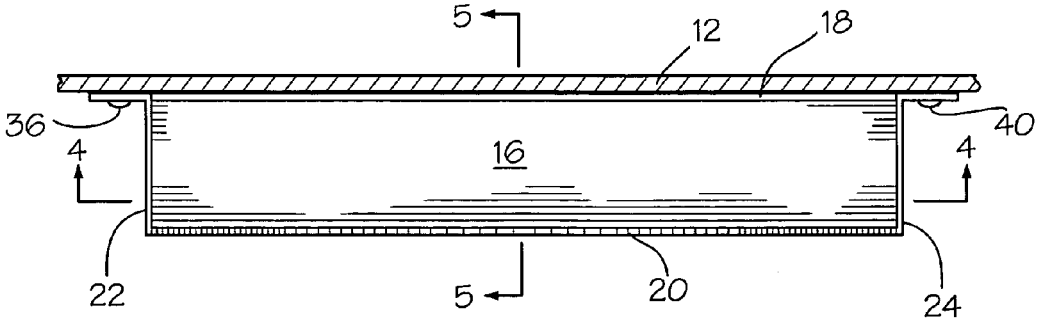
FIG. 3 is a diagrammatic top view of the shelf device of FIG. 1.
Figure 4:
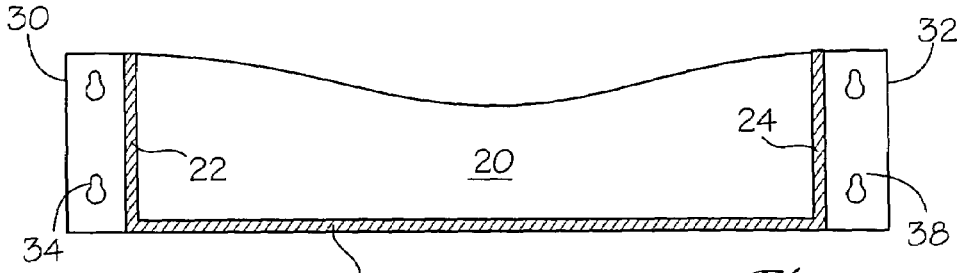
FIG. 4 is a diagrammatic sectional view of the shelf device taken along line 4—4 of FIG. 3.

Referring to FIGS. 1–4, a shelf device 10 is attached to an inside surface of an upright cooler door 12. Articles, such as beverage containers for example, can be placed on shelf device 10 for easy viewing through the cooler door 12 which minimizes the need to open the door to view the contents. It also utilizes the door space for storing additional product in a space that would otherwise be wasted.

Shelf device 10 has a tray 14 with a bottom panel 16, opposed front and rear panels 18, 20 connected to bottom panel 16, and opposed left and right end panels 22, 24 connected to bottom panel 16 front panel 18 and rear panel 20. Front panel 18 has a rear face opposite rear panel 20 and also has a front face facing cooler door 12. Tray 14 is open at the top to receive containers. The front tray panel 18 and end panels 22, 24 each have a height sufficient for preventing a container from tipping as the door is opened or closed. Rear panel 20 preferably extends upward from bottom panel 16 a greater distance than front panel 18. Front panel 18 can be lower because it does not have to prevent tipping since the inside surface of door 12 is there for abutting contact during opening and closing of door 12.

Figure 5:
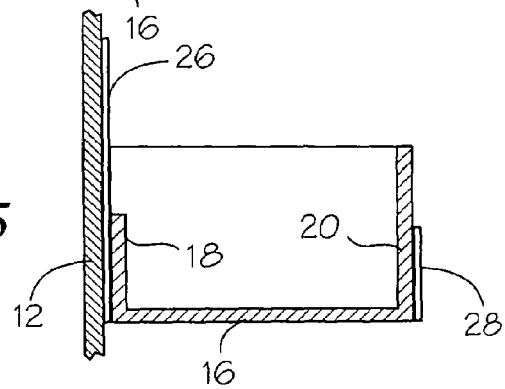
FIG. 5 is a diagrammatic sectional view of the shelf device taken along line 5—5 of FIG. 3.
Figure 6:
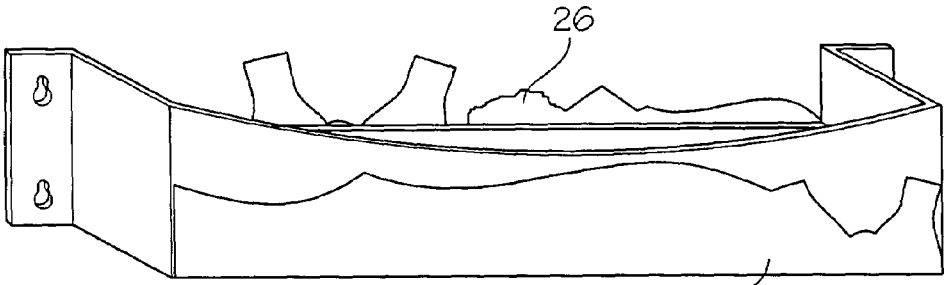
FIG. 6 is a rear perspective view similar to FIG. 1 but with display panels attached.
Figure 7:
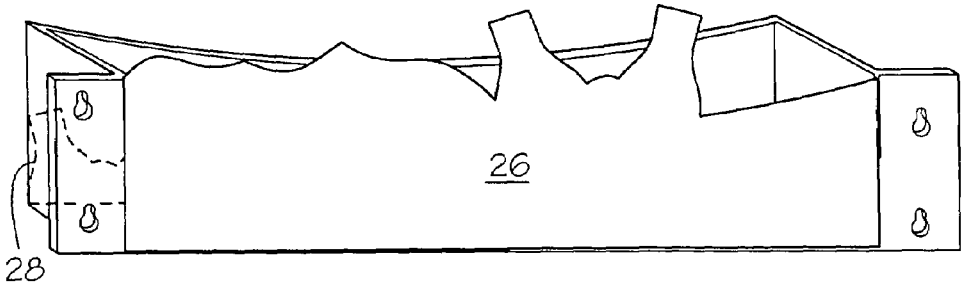
FIG. 7 is a front perspective view similar to FIG. 2 but with display panels attached.

Referring to FIGS. 5–7, a front display panel 26 is attached to the front face of front panel 18 by an adhesive or the like. Front display panel 26 has an embellished front surface facing door 12 and has a rear surface attached to the front face of front panel 18. Front display panel 26 has a greater height than front panel 18 and may be embellished with color and/or contours to simulate containers inside the cooler. For example, front display panel 26 may be contoured and colored to resemble one or more familiar beverage containers. Front panel 18 may also contain designs and be used without front display panel 26. For example, front panel 18 may have its top edge curved, like the familiar wave used on beverage container, to aid in promoting a particular brand of beverage.

Rear panel 20 may also have a display panel 28 with an embellished front surface and a rear surface attached to the front surface of rear panel 20 so that the embellishment is visible when the cooler door is open. A top portion of rear panel 20 of tray 14 extends to a higher elevation than a top portion of rear display panel 28 so that rear display panel 28 does not interfere with container insertion or removal.

ELEMENT LIST

10 shelf device
12 upright cooler door
14 tray
16 bottom panel
18 front panel
20 rear panel

22 left end panel
24 right end panel
26 front display panel
28 rear display panel
30 left flange
32 right flanges
34 opening in left flange
36 left suction cup
38 opening in right flange
40 right suction cup Referring to FIGS. 1–4, means are provided for attaching tray 14 to the inside surface of cooler door 12 which includes left and right flanges 30, 32. Left flange 30 has at least one opening 34 for receiving a hanging device 36 and is attached to left end panel 22 adjacent front panel 18. The opening 34 is preferably a slotted opening larger at the bottom than the top. Hanging device 36 may be a suction cup with a protrusion to fit through opening 34, or may a stud attached to the door with an adhesive or the like. Similarly, right flange 32 has at least one opening 38 for receiving a hanging device 40 and is attached to right end panel 24 adjacent front panel 18.

While the invention has been described with particular reference to the preferred embodiments, it will be understood by those skilled in the art that various changes may be made and equivalents may be substituted for elements of the preferred embodiments without departing from invention. For example, while it is anticipated that the shelf device will be integrally molded of transparent plastic, opaque plastic or metal could be used. It is accordingly intended that the claims shall cover all such modifications and applications as do not depart from the true spirit and scope of the invention.

What is claimed is:

1. A shelf device for an inside surface of a cooler door of a cooler housing bottles of beverage, said shelf device comprising:

A tray having a bottom panel, opposed front and rear panels connected to said bottom panel, and opposed left and right end panels connected to said bottom, front and rear panels, said front panel having a rear face opposite said rear panel and a front face, said rear panel extending upward from said bottom panel a greater distance than said front panel;

a front display panel having a front surface embellished with contours and color to simulate one of said bottles of beverage and having a rear surface attached to said front surface of said front panel of said tray, a top portion of said front display panel extending to a higher elevation than a top portion of said front panel of said tray to simulate one of said bottles of beverage; and means for attaching a front portion of said tray to said inside surface of said cooler door, said means including a left flange having at least one opening for receiving a hanging device and being attached to said left end panel adjacent said front panel, and a right flange having at least one opening for receiving a hanging device and being attached to said right end panel adjacent said front panel.

2. A shelf device, as set forth in claim 1, including a rear display panel having an embellished front surface and having a rear surface attached to a rear surface of said rear panel of said tray, wherein a top portion of said rear panel of said tray extends to a higher elevation than a top portion of said rear display panel.

* * * * *